US008225728B2

(12) United States Patent
Fujihara

(10) Patent No.: US 8,225,728 B2
(45) Date of Patent: Jul. 24, 2012

(54) MULTI-NEEDLE SEWING MACHINE

(75) Inventor: Shinya Fujihara, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 267 days.

(21) Appl. No.: 12/659,490

(22) Filed: Mar. 10, 2010

(65) Prior Publication Data

US 2010/0242821 A1 Sep. 30, 2010

(51) Int. Cl.
*D05B 69/10* (2006.01)
*D05B 69/30* (2006.01)

(52) U.S. Cl. ..... 112/270; 112/220; 112/167

(58) Field of Classification Search ..... 112/470.01–470.18, 163–167, 112/270–277, 220, 221; 248/49; 59/78.1; 174/651, 69, 86
See application file for complete search history.

(56) References Cited

U.S. PATENT DOCUMENTS

| | | | | |
|---|---|---|---|---|
| 2,472,244 | A * | 6/1949 | Brady | 38/107 |
| 2,680,789 | A * | 6/1954 | Robinson | 191/12 S |
| 2,836,133 | A * | 5/1958 | Gamble et al. | 112/470.12 |
| 3,009,428 | A * | 11/1961 | Coolidge | 112/470.12 |
| 3,251,147 | A * | 5/1966 | Foster | 38/30 |
| 4,583,181 | A * | 4/1986 | Gerber et al. | 700/143 |
| 4,690,466 | A * | 9/1987 | Bakr et al. | 312/29 |
| 4,864,947 | A * | 9/1989 | Iwase | 112/470.13 |
| 4,905,615 | A * | 3/1990 | Pofferi | 112/2.1 |
| 6,257,897 | B1 * | 7/2001 | Kubota | 439/34 |

FOREIGN PATENT DOCUMENTS

| | | |
|---|---|---|
| JP | Y2-2566188 | 3/1998 |
| JP | A-2001-330738 | 11/2001 |

OTHER PUBLICATIONS

Feb. 17, 2012 Office Action issued in Japanese Patent Application No. 2009-079168 (with translation).

* cited by examiner

*Primary Examiner* — Ismael Izaguirre
(74) *Attorney, Agent, or Firm* — Oliff & Berridge, PLC

(57) ABSTRACT

A multi-needle sewing machine including a needle-bar case transfer mechanism transferring a needle-bar case relative to a sewing machine body and a first wiring and a second wiring each connected to an electrical component provided at the needle-bar case and that is extended across the sewing machine body and the needle-bar case. The first and the second wiring are held such that the first wiring and the second wiring are separated in a direction of transfer of the needle-bar case and a first intermediate portion of the first wiring and a second intermediate portion of the second wiring are curved so as to either cross over or proximate one another to allow the first wiring and the second wiring to be moved relative to one another at the first intermediate portion and the second intermediate portion.

9 Claims, 11 Drawing Sheets

MULTI-NEEDLE SEWING MACHINE

CROSS-REFERENCE TO RELATED APPLICATION

This application is based upon and claims the benefit of priority from the prior Japanese Patent Application 2009-079168, filed on, Mar. 27, 2009, the entire contents of which are incorporated herein by reference.

FIELD

The present disclosure relates to a multi-needle sewing machine provided with a needle-bar case transfer mechanism that transfers a needle-bar case relative to the body of the sewing machine and a first wiring and a second wiring extended across the needle-bar case and the body of the sewing machine.

BACKGROUND

Typical industrial sewing machines have been conventionally provided with a transfer element such as a holder for holding a workpiece cloth that is transferred relative to the body of the sewing machine. Such type of sewing machine requires wiring such as lead wires extending across the sewing machine body and the transfer element to be of a length that allows movement of the transfer element, meaning that some extra length needs to be obtained. In view of such play in the length, the wiring needs to be organized so that they do not interfere with the movement of the transfer element to eliminate the possibility of damaging and disconnections caused by the intermediate portions of the wiring being entangled with the components of the sewing machine.

To address such concerns, sewing machines have been provided with wiring organizers. For instance, such sewing machine is provided with a holder for holding a workpiece cloth spread out on a sewing machine table, and a couple of transfer mechanisms that transfer the holder in a first direction along a guide rail provided on the sewing machine table and a second direction orthogonal to the first direction, respectively. The wirings that connect components such as an actuator for activating the holder and control-related sections provided below the sewing machine base, or in the sewing machine body side, are drawn upward from the sewing machine base to be hung at their intermediate portions by a fastener. The fastener is provided in the form of a bar at one of the transfer mechanisms and has a hook-shaped placement at its tip. The wirings are placed on the placement of the fastener and tied to the bar shaped portion of the fastener by strings, for instance.

Since the wiring organizer allows play in the length of the wirings, the wirings hang down from time to time between the fastener and the holder, serving as the transfer element, by the movement of the transfer element. Because the intermediate portions of the wirings are placed on the hooked shaped placement of the fastener, there is a risk of the wirings being displaced from the placement and coming in contact with the components of the sewing machine.

The multi-needle sewing machine is typically provided with a needle-bar case, as described earlier, that supports a plurality of needle bars so as to be movable up and down. By transferring the needle-bar case relative to the sewing machine body, one of the needle bars is selectively switched to a position opposing a needle drop position of the needle bar. Thus, when extending the wiring or electrical cords across the sewing machine body and the needle-bar case, the wirings need to be organized so that they do not entangle with the components of the sewing machine even when the wirings slack by the movement of the needle-bar case.

SUMMARY

One object of the present disclosure is to provide a multi-needle sewing machine that eliminates slacking of the wiring extending across the sewing machine body and the needle-bar case, and at the same time reliably preventing failures such as damaging and disconnections of the wirings.

In one aspect of the present disclosure, a multi-needle sewing machine provided with a sewing machine body includes a plurality of needle bars that each allow attachment of a sewing needle at a lower end thereof; a needle-bar case that supports the plurality of needle bars so as to be movable up and down; a needle-bar case transfer mechanism that selectively switches one of the plurality of needle bars to a needle drop position by transferring the needle-bar case relative to the sewing machine body; a first wiring and a second wiring that are each connected to an electrical component provided at the needle-bar case and that is extended across the sewing machine body and the needle-bar case; wherein the first and the second wiring are held such that the first wiring and the second wiring are separated in a direction of transfer of the needle-bar case and a first intermediate portion of the first wiring and a second intermediate portion of the second wiring are curved so as to either cross over or proximate one another to allow the first wiring and the second wiring to be moved relative to one another at the first intermediate portion and the second intermediate portion.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

Figure 1:
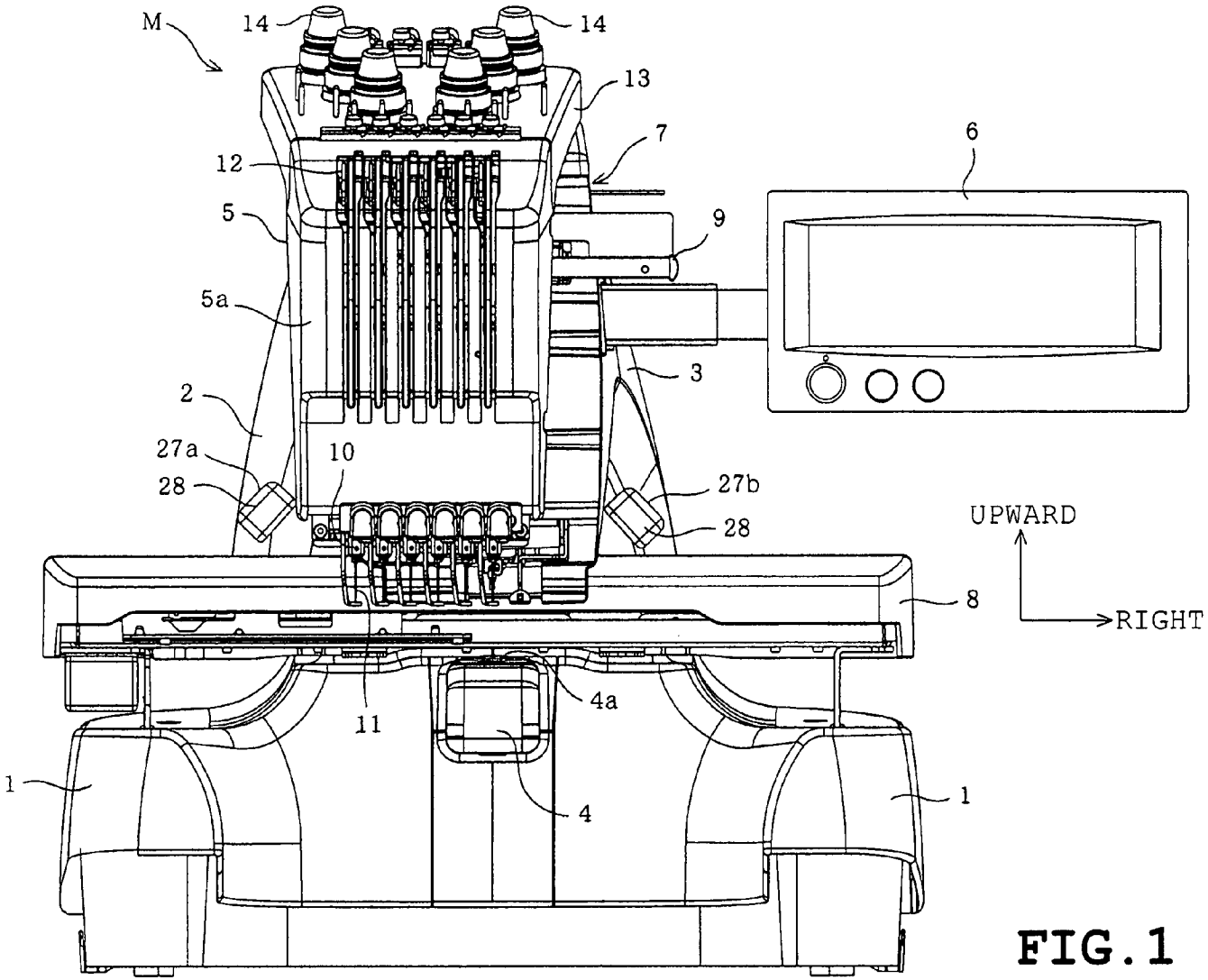
FIG. 1 is an overall front view of a multi-needle sewing, machine according to a first exemplary embodiment of the present disclosure.

A first exemplary embodiment applying the present disclosure to a multi-needle embroidery sewing machine, hereinafter referred to as a multi-needle sewing machine M, will be described with reference to FIGS. 1 to 13B. FIG. 1 provides a perspective overall view of multi-needle sewing machine M as seen from a user positioned in front of it. The description is given hereinafter with an assumption that the direction in which the operator or the user positions himself/herself relative to multi-needle sewing machine M is the front side.

Referring to FIG. 1, multi-needle sewing machine M is primarily configured by a pair of left and right feet 1 that supports the multi-needle sewing machine M in its entirety, pillar 2 standing at the rear end of feet 1, arm 3 extending forward from the upper portion of pillar 2, cylinder bed 4 extending forward from the lower end of pillar 2, and needle-bar case 5 attached to the front end of arm 3.

Feet 1, pillar 2, arm 3, and cylinder bed 4 are provided integrally with sewing machine body 7. Sewing machine body 7 is provided with components such as a controller not shown that are responsible for the overall control of multi-needle sewing machine M and control panel 6. On the upper surface of cylinder bed 4, needle plate 4*a* only shown in FIG. 1 is provided that has a needle hole not shown and that may also be referred to as a needle drop position of a later described sewing needle 11.

Above feet 1, carriage 8 oriented in the left and right direction is disposed which contains an X-drive mechanism not shown that drives a frame mount base not shown provided in front of carriage 8 in the X direction or the left and right direction. Within the left and right feet 1, a Y-direction drive mechanism is provided that drives carriage 8 in the Y direction or the front and rear direction. The workpiece cloth not shown to be embroidered is held by a rectangular embroidery frame not shown which is mounted on the frame mount base. The embroidery frame being driven by the Y-direction drive mechanism and the X-direction drive mechanism is transferred in the Y direction in synchronism with carriage 8 or in the X direction along with the frame mount base, to allow the workpiece cloth to be fed.

Though not shown, above arm 3 of sewing machine body 7, a thread supplier is provided that has six thread pins each being mounted with a thread spool. On the front end of the arm 3, guide rail 9 is provided that extends in the left and right direction which slidably supports needle-bar case 5.

Figure 2:
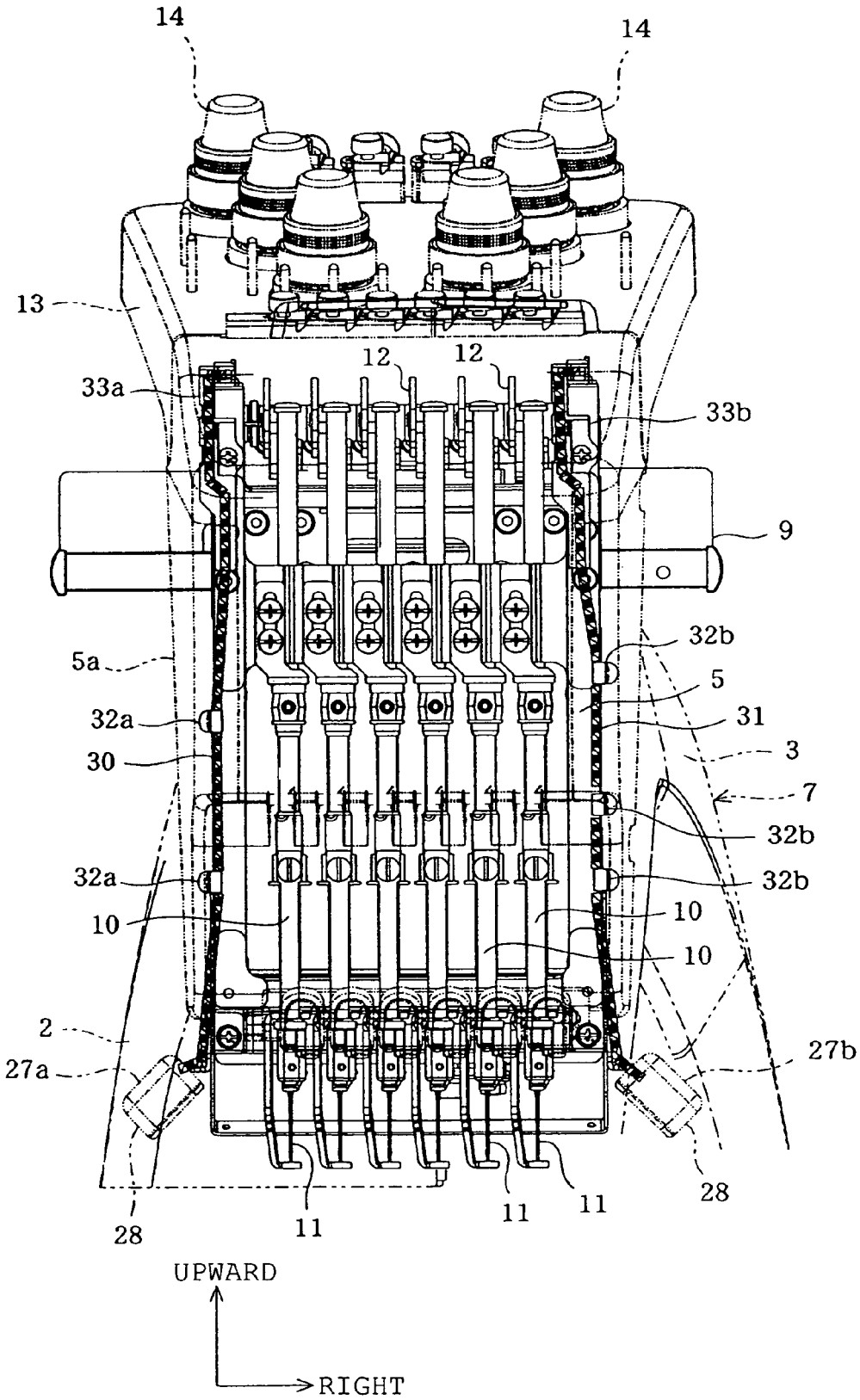
FIG. 2 is an enlarged front view of a needle-bar case and internal structures of its peripheral components.

Next a description will be given on needle-bar case 5 and its peripheral structures with reference to FIGS. 2 to 4.

Needle-bar case 5 supports six vertically extending needle bars 10 that are arranged side by side in the left and right direction. Needle bars 10 are allowed to move up and down and each needle bar 10 has sewing needle 11 attached on its lower end. Needle-bar case 5 is further provided with six thread take-ups 12 that are associated with the six needle bars 10. Thread take-ups 12 are also allowed to move up and down. As indicated in double-dot chain line in FIGS. 2 to 4, needle-bar case 5 has a synthetic resin cover 5*a* attached on its front side and a forwardly declining thread tension regulator base 13 on its upper side that merges in continuation with the upper end of cover 5*a*. Thread tension regulator base 13 is provided with six thread tension regulators 14 for making adjustments in thread tension of the needle thread supplied to each sewing needle 11. The needle thread drawn from each of the thread pins is engaged with the corresponding thread tension regulator 14 and thread take-up 12 etc., and thereafter supplied to the eye not shown of the corresponding sewing needle 11.

Needle-bar case 5 is generally reverse L-shaped in side view and is provided with roller mount plate 15 extending in the left and right direction on its upper rear end. Roller mount plate 15 has six roller shafts 17*a* associated with the six needle bars 10 that are spaced equally with the corresponding needle bars 10. Roller shafts 17*a* protrude in the front and rear direction and cylindrical roller 17*b* is provided rotatably behind each roller shaft 17*a*.

Figure 5A:
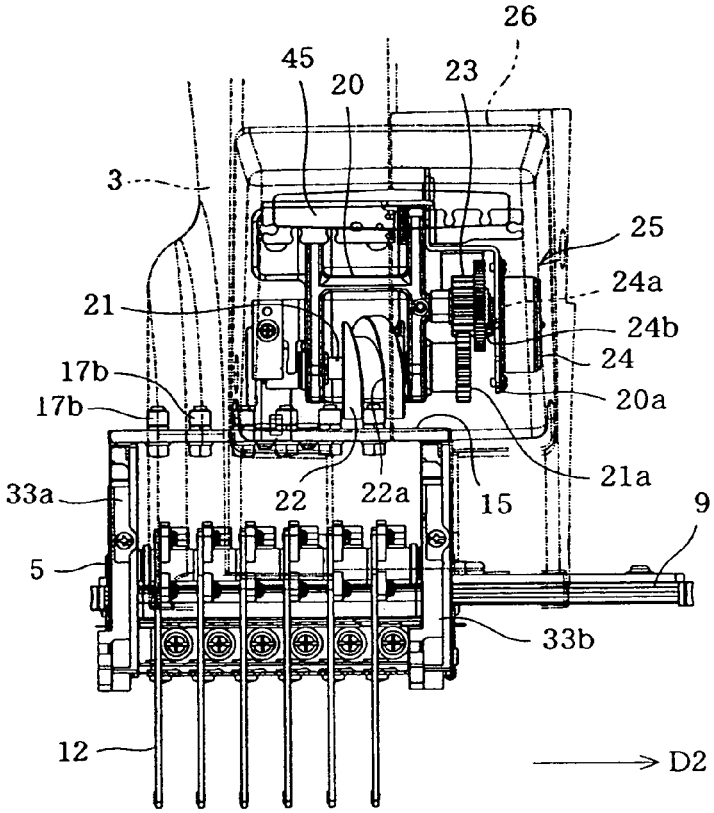
FIG. 5A is a plan view illustrating the needle-bar case in a leftmost position, and a needle-bar case transfer mechanism.

On the other hand, as shown in FIG. 5A, provided on arm 3 of sewing machine 7 side is a sewing machine frame hereinafter referred to as fixture frame 20 that is H-shaped in plan view. Fixture frame 20 is provided with rotary shaft 21 oriented in the left and right direction. On the axial mid portion of rotary shaft 21, spiral cam face 22*a* is affixed that has a spiral cam 22 capable of being engaged with one of the six rollers 17*b*. Rotary shaft 21 further has gear 21*a* secured at its right end. On the right side of fixture frame 20, auxiliary frame 20*a* formed in a crank-like shape is secured to accommodate deceleration gear mechanism 23, which meshes with gear 21*a*, within the space defined between fixture frame 20 and auxiliary frame 20*a*. On the right side of auxiliary frame 20*a*, needle-bar case transfer motor 24 is secured that comprises a step motor. Rotary shaft 24*a* of motor 24 penetrates auxiliary frame 20*a* and gear 24*b* provided at the tip of rotary shaft 24*a* meshes with deceleration gear mechanism 23.

When needle-bar case transfer motor 24 is driven in the normal or reverse direction, the rotational movement is transmitted to rotary shaft 21 by way of deceleration gear mechanism 23 to cause spiral cam 22 to rotate. As spiral cam 22 rotates, it travels across rollers 17*b* one by one through engagement with each roller 17*b* from the left to right or vice versa thus, transferring needle-bar case 5 leftward indicated by arrow D1 in FIG. 5B or rightward indicated by arrow D2 in FIG. 5A. The above described components such as rotary shaft 21, spiral cam 22, and deceleration gear mechanism 23, gears 21*a* and 24*b*, and needle-bar case transfer motor 24 taken together with roller shaft 17*a* and rollers 17*b* constitute needle-bar case transfer mechanism 25. Thus, needle-bar case transfer mechanism 25 transfers needle-bar case 5 in the left and right direction relative to sewing machine body 7 to selectively switch one of the six pairs of needle bars 10 and thread take-up 12 to the needle drop position, in other words, the active position. The selected pair of needle bar 10 and thread take-ups 12 is driven up and down in synchronism by a sewing machine motor not shown provided at pillar 2 while co-operating with rotary shuttle not shown provided at the front end of cylinder bed 4 to form embroidery stitches on the workpiece cloth held by the embroidery frame.

Figure 3:
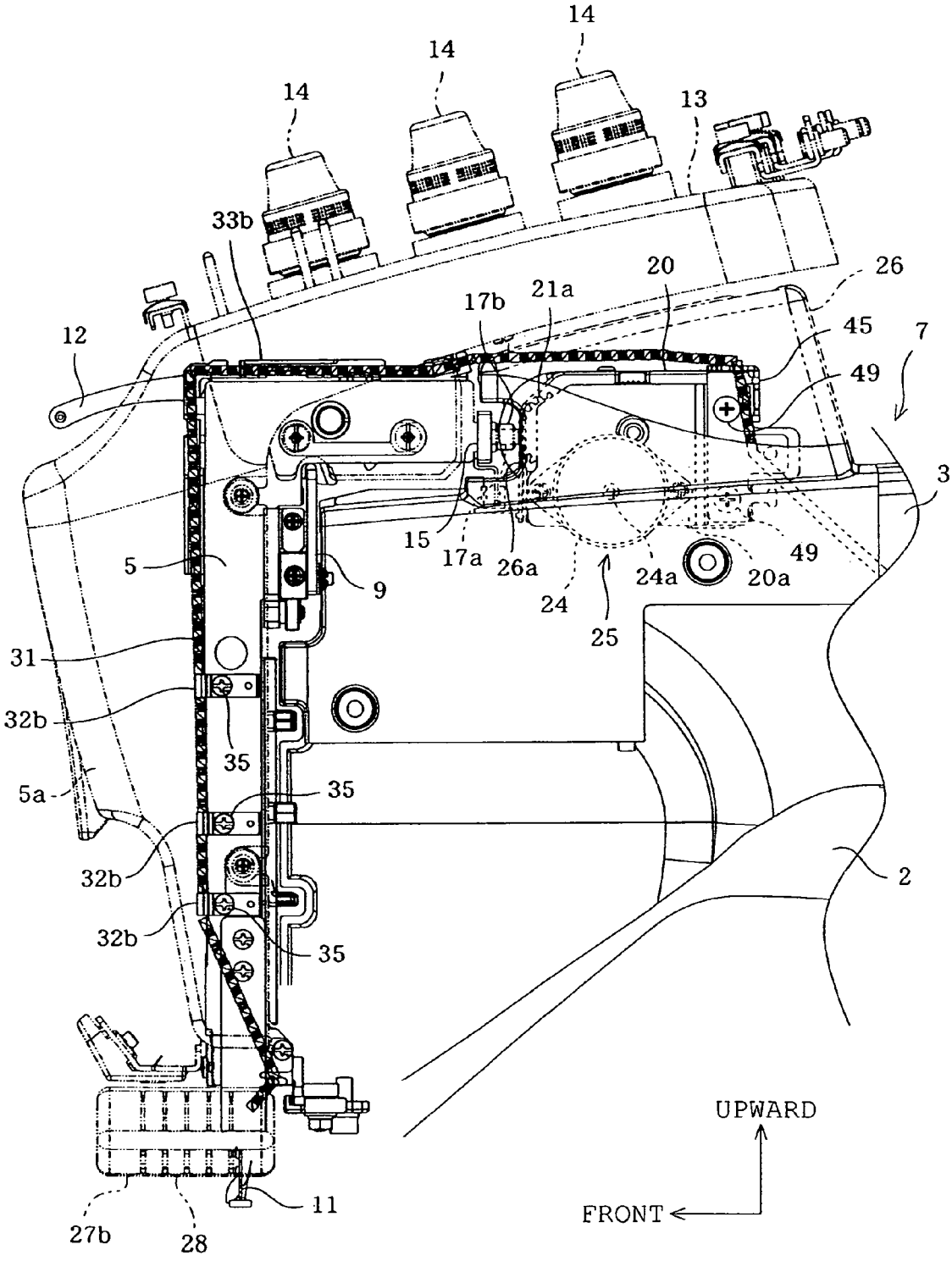
FIG. 3 is a side view of FIG. 2.

As can be seen in FIG. 3, needle-bar case transfer mechanism 25 is located above arm 3 and is covered by upper cover 26 substantially shaped as a rectangular container. Though not described in detail, on the front portion of upper cover 26, openings 26*a* are defined to accommodate rollers 17*b* and as well as a slots not shown that allows free movement of later described a first wiring 30 and a second wiring 31.

Needle-bar case 5 is provided with electrical components, one example of which is a couple of lights 27*a* and 27*b*. Light 27*a* includes a rectangular cover 28 serving as an exterior housing and a light source not shown such as a chip LED (light emitting diode) not shown provided within cover 28. Chip LED is implemented on a substrate not shown within cover 28 and a connector not shown is provided on the substrate to which a lead wire hereinafter referred to as the first wiring 30 is connected for supplying electricity to the LED. Likewise, light 27*b* is provided with cover 28 and a chip LED which is implemented on a substrate within cover 28. The lead wire, hereinafter referred to as the second wiring is 31 is connected to the connector provided on the substrate on which LED is implemented. Light 27*a* and light 27*b* are mounted at the lower end left side and right side of needle-bar case 5, respectively to provide enough work space in the front side of components such as needle bar 10 and sewing needle 11 without interfering with needle threading or sewing needle 11 replacement work and at the same time providing sufficient lighting on the surface of the workpiece cloth.

The first and second wirings 30 and 31 are bendable and thus, run from the connector to the front and upper surfaces of needle-bar case 5 to extend over to arm 3 of sewing machine body 7 side to be connected to controller. The support structure of the first and the second wirings 30 and 31 will be described with reference to FIGS. 6A to 12B. FIGS. 2 to 4 schematically illustrate the distribution path of the wirings for simplicity.

Fastening elements are provided at both the needle-bar case side and the sewing machine body 7 side to separate the first wiring 30 and the second wiring 31 to the left and right. To elaborate, as show in FIGS. 2 and 3, on the front portion of needle-bar case 5, a plurality of wire fasteners 32*a* is provided to line the first wiring 30 along the left side of needle-bar case 5. Likewise, a plurality of wire fasteners 32*b* is provided to line the second wiring 31 along the right side of needle-bar case 5. The present exemplary embodiment applies two pieces of wire fasteners 32*a* and 32*b*, one in the upper portion and one in the lower portion for both the left and right sides.

Figure 6A:
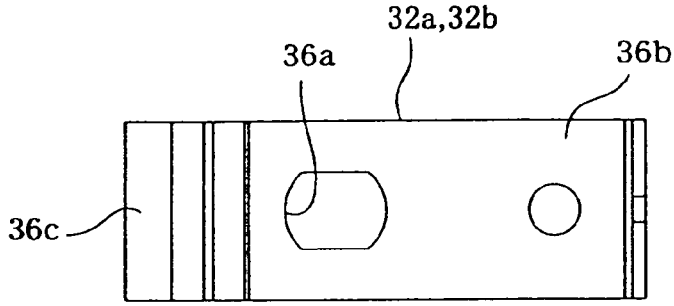
FIG. 6A is an enlarged side view of wiring fastener elements.
Figure 6B:
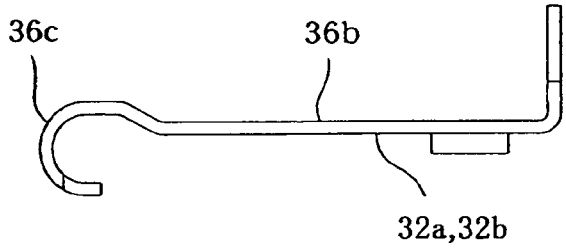
FIG. 6B is a plan view of FIG. 6A.
Figure 7:
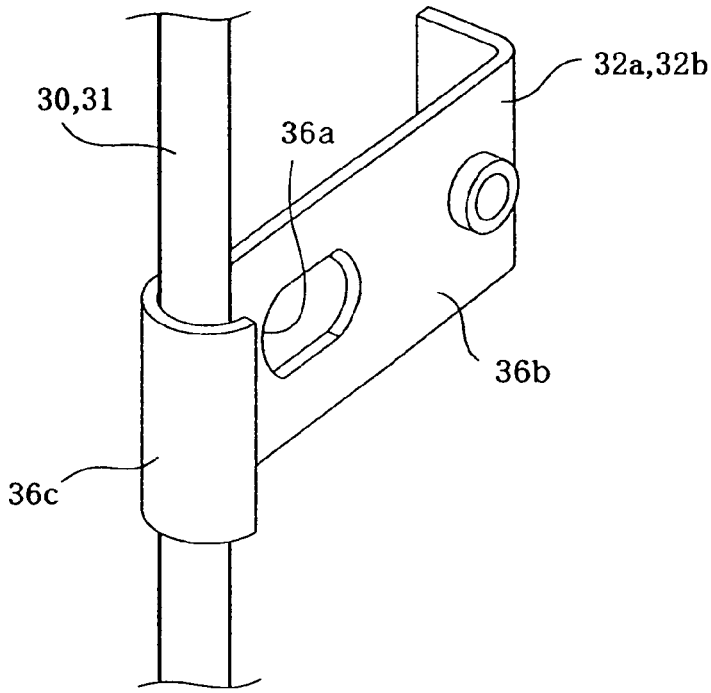
FIG. 7 is an enlarged perspective view of wiring fastening element shown with wirings.

Wire fasteners 32*a* and 32*b* are identical to one another. As can be seen in FIGS. 6A, 6B, and 7, wire fasteners 32*a* and 32*b* are made of metal plates provided integrally with helical holes 36*a*, fasteners 36*b* that curve in L-shape along the sidewalls of needle-bar case 5, and hook-shaped inserts 36*c* into which the first wiring 30 or the second wiring 31 is inserted. Wiring fasteners 32*a* and 32*b* are provided on the left and right front sides of needle-bar case 5, respectively by screws 35 shown in FIG. 3 inserted into inserts 36*a*.

Figure 4:
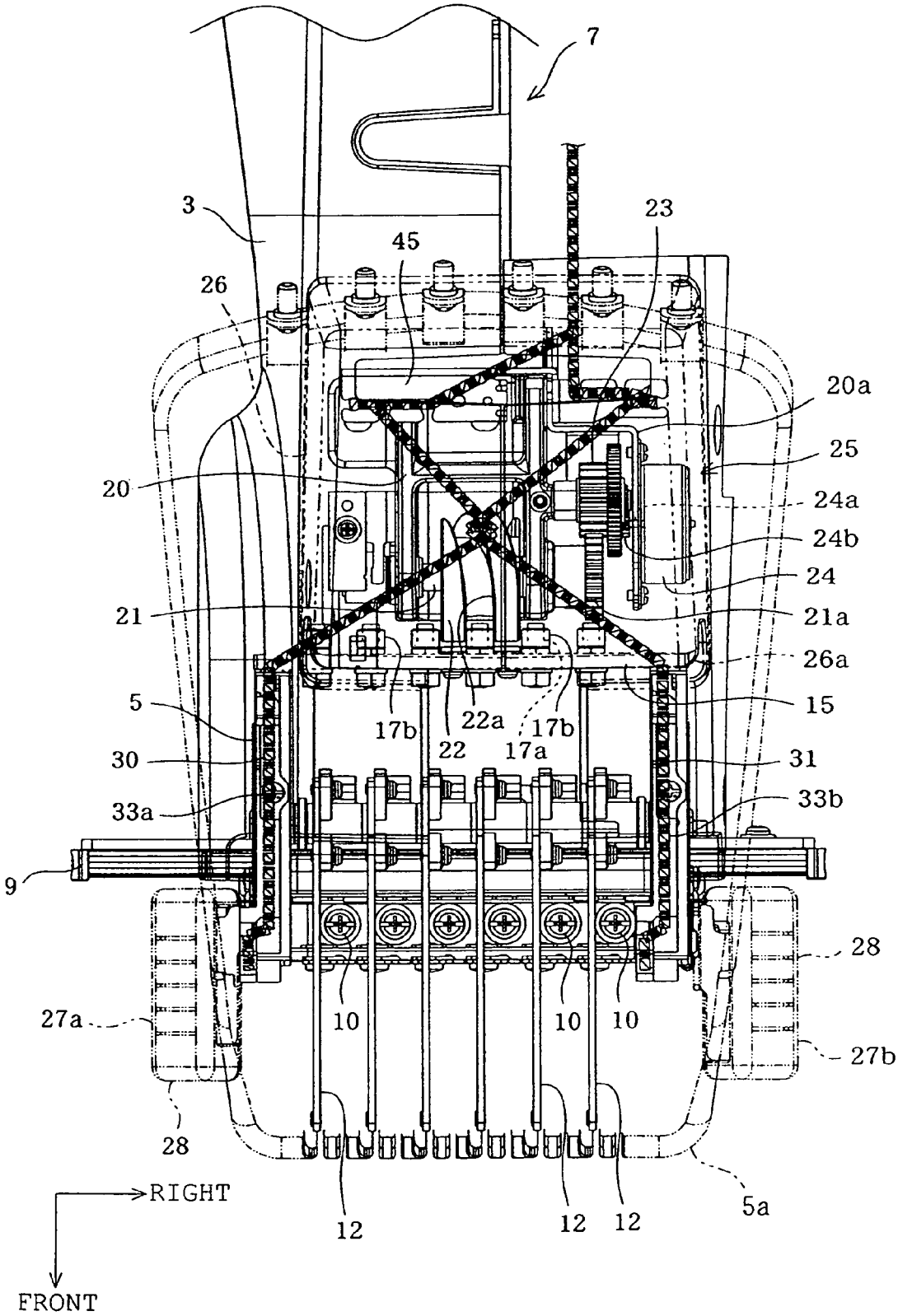
FIG. 4 is a plan view of FIG. 2.
Figure 8A:
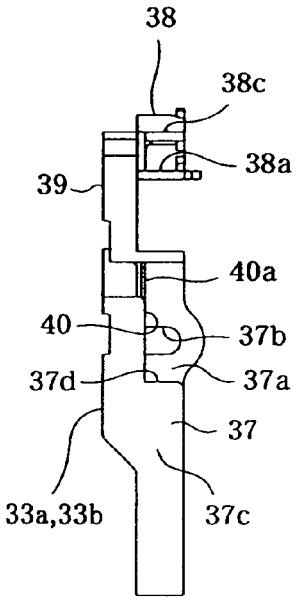
FIG. 8A is an enlarged front view of needle-bar case side fasteners.
Figure 8B:
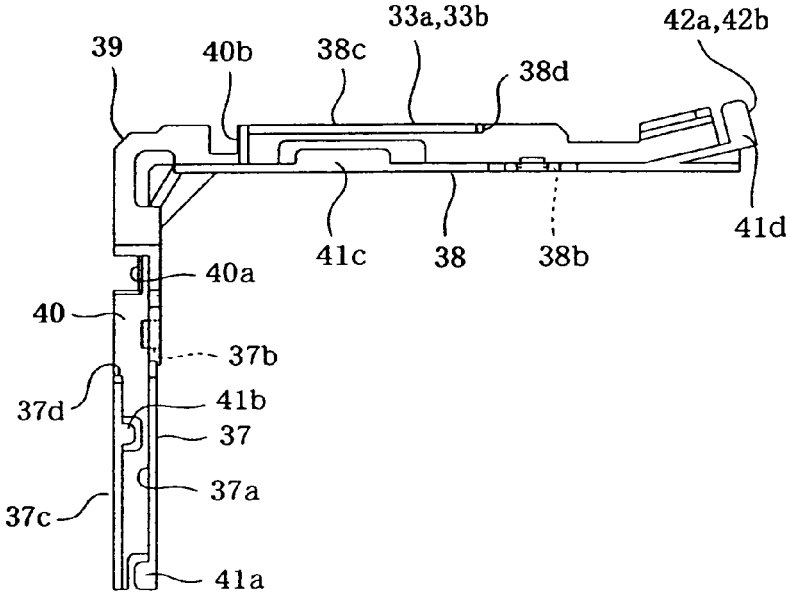
FIG. 8B is a side view of FIG. 8A.
Figure 9:
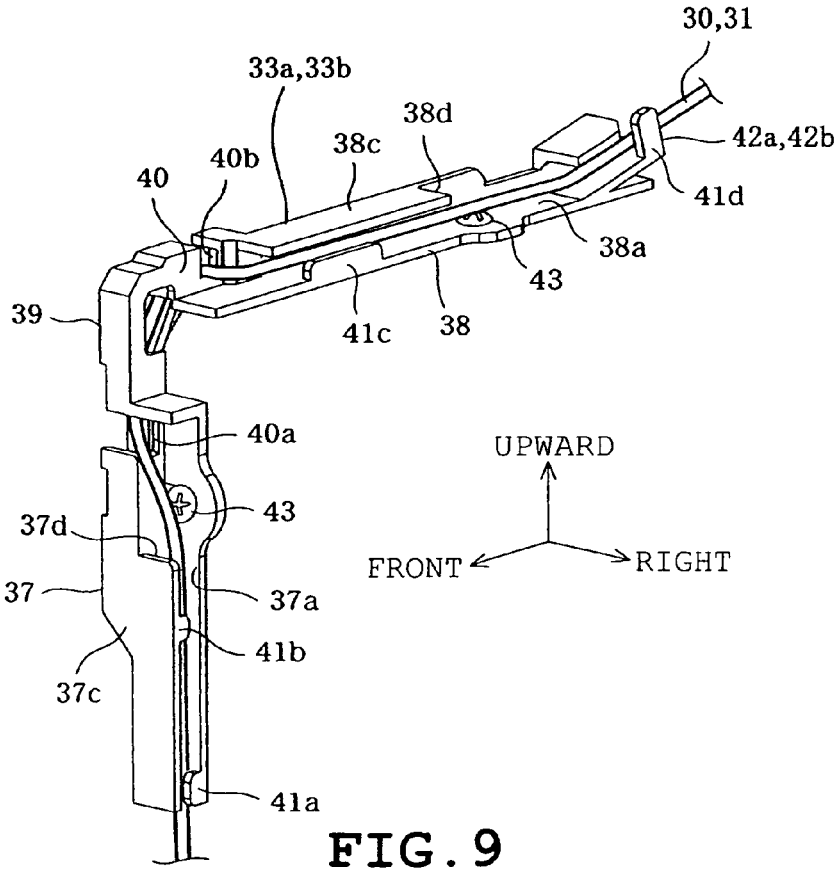
FIG. 9 is an enlarged perspective view of the needle-bar case side fasteners shown with wirings.
Figure 12A:
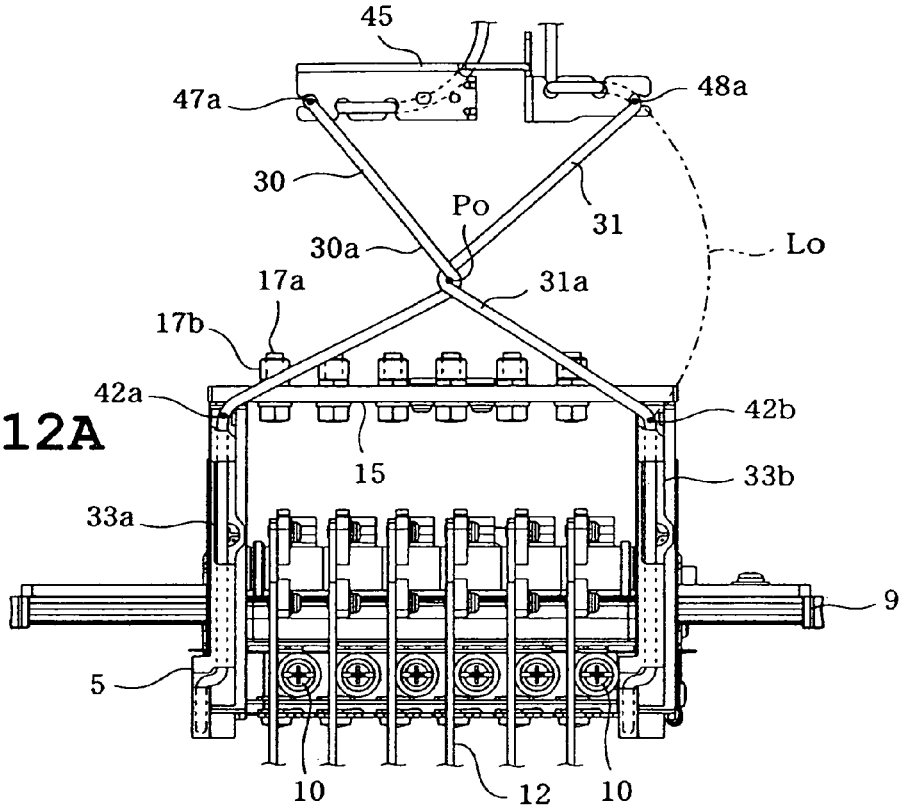
FIG. 12A is an explanatory plan view illustrating states of a first wiring and a second wiring when the needle-bar case is transferred to a middle position.

As can be seen in FIGS. 3, 4, and 12A, on the upper portion of needle-bar case 5, needle-bar case side fastener 33*a* is provided to line the first wiring 30 along the left side of needle-bar case 5. Likewise, a needle-bar case side fastener 33*b* is provided to line the second wiring 31 along the right side of needle-bar case 5. Wire fasteners 33*a* and 33*b* are identical to one another. As shown in FIGS. 8A, 8B, and 9, needle-bar case side fastener elements 33*a* and 33*b* are made of synthetic resin and are generally reversed L-shaped being provided with horizontal section 38 and vertical section 37 that are lined along the upper portion of needle-bar case 5. As shown in FIG. 8A, between vertical section 37 and horizontal section 38, projecting section 39 is provided integrally that projects leftward in front view. The right sides of vertical section 37 and horizontal sections 38 are opened whereas the left side of projecting section 39 is opened. Vertical section 37, horizontal section 38, and projecting section 39 are parted to the left and right by partition 40 which has insert grooves 40*a* and 40*b* defined on it. On rear wall 37*a* of vertical section 37, screw hole 37*b* is defined whereas on front wall 37*c*, notch 37*d* is defined at a portion corresponding to screw hole 37*b*. Horizontal section 38 has bottom wall 38*a* having screw hole 38*b* defined on it and upper wall 38*c* having notch 38*d* defined at a portion corresponding to screw hole 38*b*. Vertical section 37 and horizontal section 38 have ribs 41*a* to 41*d* formed on them that extend the direction to cover their openings defined on their right sides.

Needle-bar case side fasteners 33*a* and 33*b* are mounted on the upper left and right sides of needle-bar case 5 by screws 43 inserted through screw holes 37*b* and 38*b*. First wiring 30 is lined along vertical section 37, insert groove 40*a*, projecting section 39, insert groove 40*b*, and horizontal section 38, curving from time to time, to be covered by needle-bar case side fastener 33*a*. Second wiring 31 is lined in the same route, curving from time to time, to be covered by needle-bar case side fastener 33*b*. Thus, first and second wirings 30 and 31 are fastened unmovably by needle-bar case side fasteners 33*a* and 33*b*, respectively. The rear end of horizontal sections 38 of needle-bar case side fasteners 33*a* and 33*b*, where ribs 41*d* are provided, define fastening sections 42*a* and 42*b* that are inclined rearwardly upward. Thus, the first and second wirings 30 and 31 maintain their relative positioning at the rear end or the stationary end of needle-bar case 5 even when needle-bar case 5 is moved.

Figure 5B:
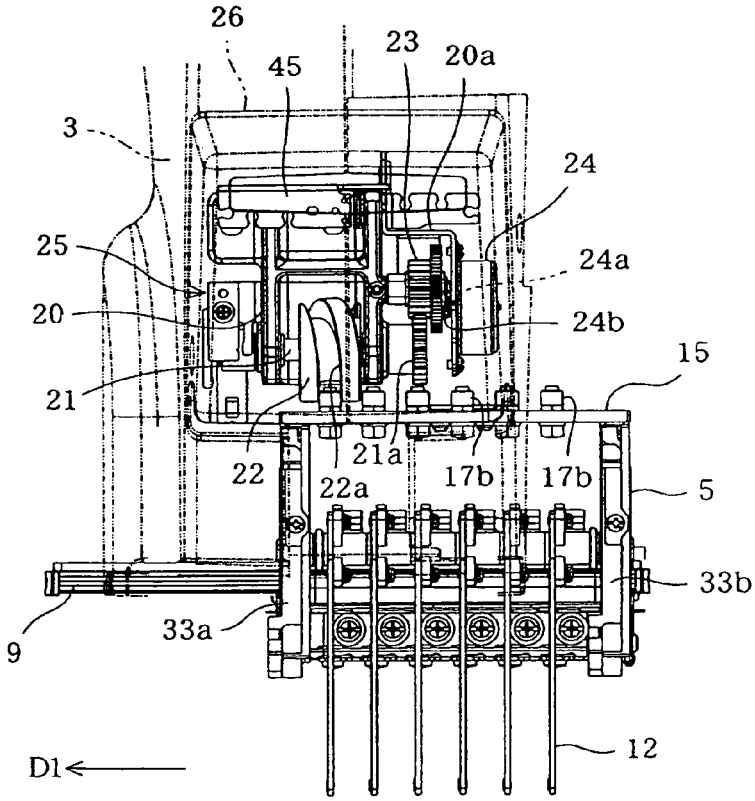
FIG. 5B is a plan view illustrating the needle-bar case in a rightmost position, and the needle-bar case transfer mechanism.

Referring to FIGS. 4, 5A, and 5B, on the rear portion of the H-shaped fixture frame 20, body side fastener 45 is provided for fastening the first and the second wirings 30 and 31 so that they stay separated to the left and right at sewing machine body 7 side.

Figure 10A:
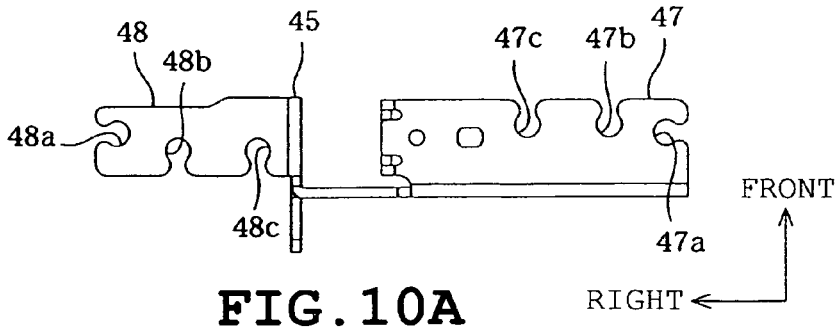
FIG. 10A is an enlarged plan view of body side fasteners.
Figure 10B:
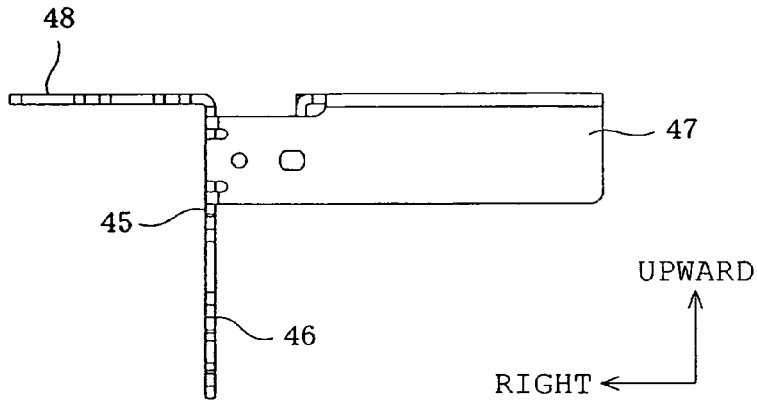
FIG. 10B is a rear side view of FIG. 10A.
Figure 11:
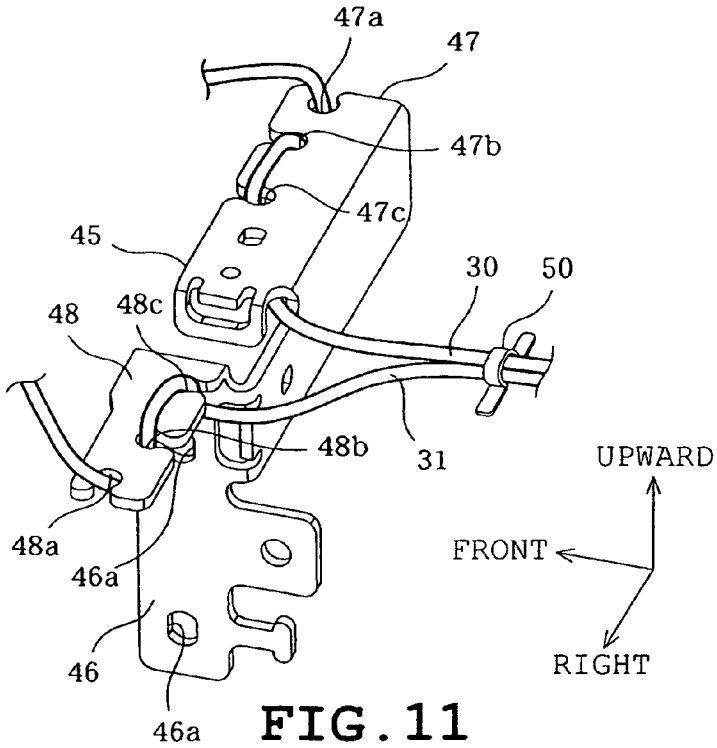
FIG. 11 is an enlarged perspective view of the body side fasteners shown with wirings.

As can be seen in FIGS. 10A, 10B, and 11, body side fastener 45 is made of a metal plate that is bent into a substantially T-form. Body side fastener 45 is integrally provided with vertically extending attachment section 46 provided with a pair of screw holes 46*a* and left side extension 47 and right side extension 48 that extend leftward and rightward from the upper end of attachment section 46. Left side extension 47 and right side extension 48 are provided with a plurality of round grooves 47*a* to 48*c* that are spaced from one another in the left and right direction. The left end groove 47*a* provided on left side extension 47 opens up to the left side whereas the other grooves 47*b* and 47*c* open up to the front side. The right end groove 48*a* provided on right side extension 48 opens up to the right side whereas the other grooves 48*b* and 48*c* open up to the rear side.

Body side fastener 45 is attached to fixture frame 20 by screw 49 only shown in FIG. 3 inserted through screw hole 46*a* and a screw hole not shown provided at auxiliary frame 20*a*, with attachment section 46 and auxiliary frame 20*a* placed against one another from the left and right sides. First wiring 30 is inserted through grooves 47*a*, 47*b*, and 47*c* so as to curve its way along the underside and the upper side of left side extension 47 in a non-linear fashion. Likewise, second wiring 31 is inserted through grooves 48*a*, 48*b*, and 48*c* so as to curve its way along the underside and the upper side of right side extension 48 in a non-linear fashion. Thus, first and second wirings 30 and 31 are fastened unmovably by body side fastener 45. Grooves 47*a* and 48*a* hereinafter referred to as fastening sections 47*a* and 48*a* of body side fastener 45 serve as stationary ends of the first and the second wirings 30 and 31 to maintain the relative positioning of the first and the second wirings 30 and 31 at the sewing machine 7 side. As shown in FIG. 11, the first and the second wirings 30 and 31 are gathered by band 50 behind body side fastener 45.

Figure 12B:
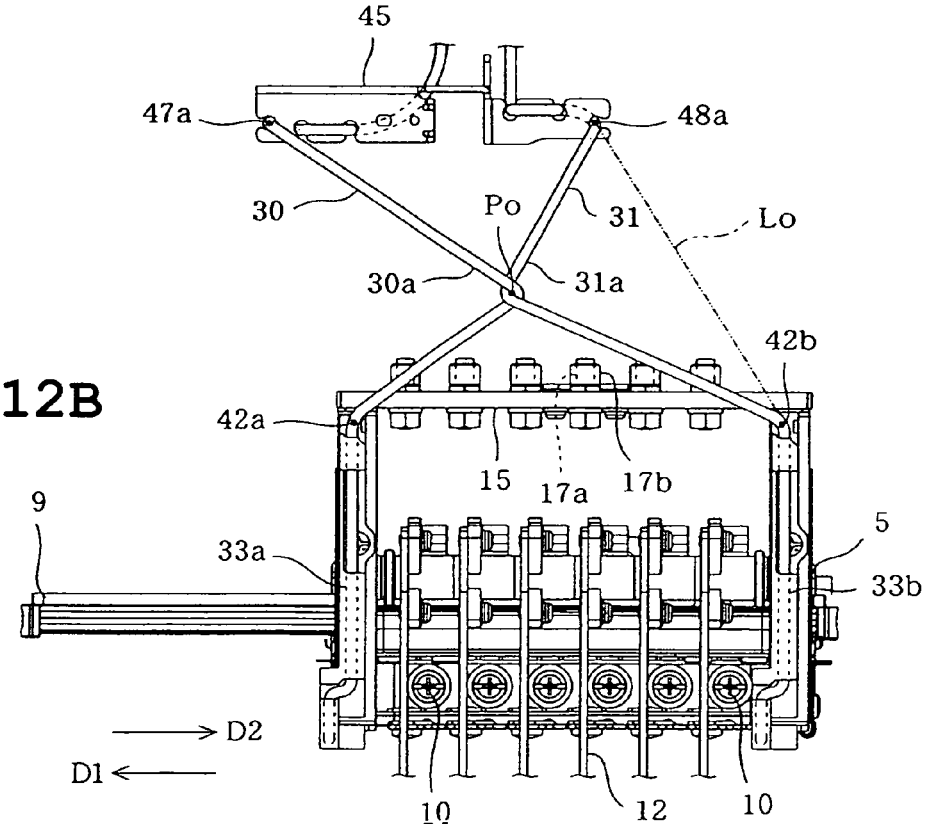
FIG. 12B corresponds to FIG. 12A showing the needle-bar case transferred to the rightmost position.

The first and the second wirings 30 and 31, extending across sewing machine body 7 and needle-bar case 5, are crossed over each other so as to curve at their intermediate portions 30*a* and 31*a*. FIGS. 12A and 12B are plan views intended for describing how the first and the second wirings 30 and 31 are organized and thus, some of the details such as needle-bar case transfer mechanism 25 are not shown.

Figure 13A:
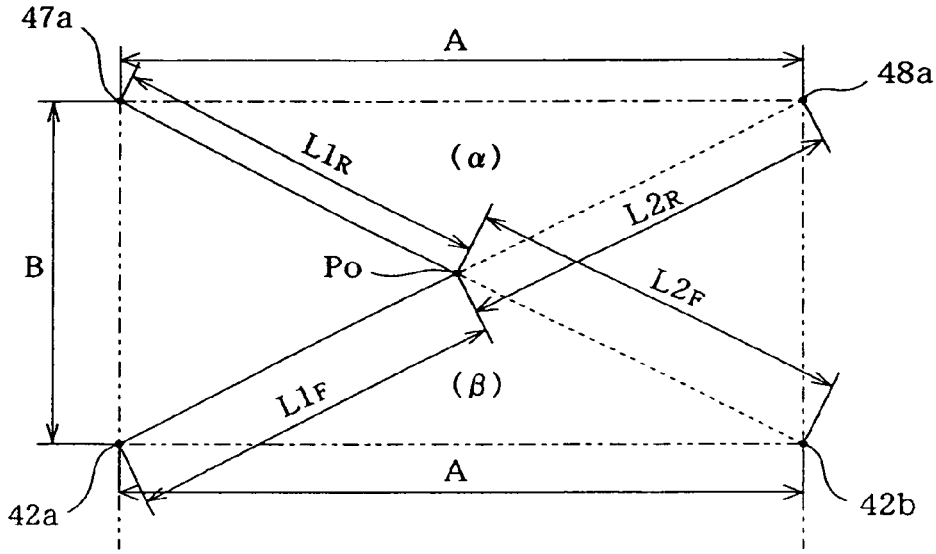
FIG. 13A is a schematic plan view illustrating the first wiring and the second wiring when the needle-bar case is moved to the middle position.

As can be seen in FIGS. 12A and 12B, the first and second wirings 30 and 31 are curved and cross over each other at their curves between body side fastener 45 and needle-bar case side fasteners 33*a* and 33*b* to exhibit a letter X like pattern in top view and a substantially horizontal profile in side view as shown in FIG. 3. The first and second wirings 30 and 31 cross over such that appropriate tension is maintained by being fastened by fasteners 42*a*, 42*b*, 47*a*, and 48*a*, so that no slacks occur at the upper surface side of needle-bar case 5. To elaborate, the first and the second wirings 30 and 31 cross over at the substantial center of an imaginary quadrilateral indicated by double-dot chain line in FIG. 13A which is formed by connecting the point of fastening at fastening sections 42*a* to 48*a*. Thus, the first wiring 30 forms the left half of the letter X between the two fastening sections 42*a* and 47*a*, whereas the second wiring 31 form the right half of the letter X between the two fastening sections 42*b* and 48*a*. The curved portions or the cross over $P_o$ of the first and second wirings 30 and 31 is located at the center of the quadrilateral. Thus, as shown in FIG. 13A, length $L1_F$ between fastening section 42*a* and cross over $P_o$; Length $L1_R$ between cross over $P_o$ and fastening section 47*a* of the first wiring 30; length $L2_F$ between fastening section 42*b* and cross over $P_o$; and Length $L2_R$ between cross over $P_o$ and fastening section 47*b* of the second wiring 31 can be represented by the following equation.

$$L1_F+L1_R=L2_F+L2_R \tag{1}$$

As can be understood from above, the first and second wirings are configured to be equal in length between body side fasteners 45 and needle-bar case side fasteners 33*a* and 33*b*. Needle-bar case 5 is transferred between the rightmost position shown in FIGS. 5B and 12B in which the leftmost needle bar 10 is switched to the needle drop position and the leftmost position shown in FIGS. 1 and 5A in which the rightmost needle bar 10 is switched to the needle drop position. Thus, the lengths of the first and second wirings 30 and 31 are both configured to be greater than the minimum length $L_o$ shown in FIGS. 12A, 12B, and 13B required for transferring needle-bar case 5 from the rightmost position to the leftmost position which can be described as $L1_F+L1_R=L2_F+L2_R>L_0$.

A description will be given hereinafter on the operation of the above described configuration.

As can be seen in FIG. 12A, when needle-bar case transfer mechanism 25 has switched the third needle bar 10 counted from the rightmost needle bar 10, in other words, the fourth needle bar 10 to the needle drop position during the embroidery sewing operation by multi-needle sewing machine M, needle-bar case 5 is positioned substantially in the middle of the rightmost position and the leftmost position. Under this state, body side fastener 45 and needle-bar case side fasteners 33*a* and 33*b* oppose each other in the front and rear direction and the first and second wirings 30 and 31 are fastened by the four fastening sections 42*a* to 48*a* so as not to slack. When needle-bar case 5 is moved from the middle position to the leftmost position or the rightmost position shown in FIG. 12B by needle bar transfer mechanism 25 to move the rightmost or the leftmost needle bar 10 to the needle drop position, needle-bar case side fasteners 33*a* and 33*b* are integrally transferred in the same direction indicated by arrow D1 or D2. Because the first and second wirings 30 and 31 are fastened by the four fasteners 42*a* to 48*a*, the transfer takes place across the substantially horizontal plane without slacking.

The change in the status of the first and second wirings 30 and 31 caused by the transfer of needle-bar case 5 will be described with reference to FIGS. 13A and 13B. For the ease of explanation, FIGS. 13A and 13B only schematically show the lines representing the first and second wirings 30 and 31 shown in FIGS. 12A and 12B, and the dimensions are also simplified from their actual measurements. The following description will be given with an assumption that A represents the distance measured in the left and right direction between fastening sections 47*a* and 48*a* and the distance measured in the left and right direction between fastening sections 42*a* and 42*b*; B represents the distance measured in the front and rear direction between fastening sections 42*a* and 47*a* and the distance measured in the front and rear direction between fastening sections 42*b* and 48*a*; and C represents the distance between the middle position of needle-bar case 5 to the rightmost position or the leftmost position. Further, as shown in FIG. 13B, lengths $L1_F'$, $L1_R'$ $L2_F'$ and $L2_R'$ of the first and second wirings 30 and 31 when needle-bar case 5 is in the rightmost position corresponds to the above described lengths $L1_F$, $L1_R$, $L2_F$, and $L2_R$.

Referring to FIG. 13A, in case the imaginary quadrilateral obtained by connecting the four fastening sections 42*a*, 42*b*, 47*a*, and 48*a* with imaginary straight lines is a rectangle, cross over $P_o$ of the first and second wirings 30 and 31 is located at the center of the rectangle. Thus, imaginary triangle a formed by side A, side $L1_R$, and $L2_R$ and triangle β formed by side A, side $L1_F$, and $L2_F$ are point symmetric to symmetric point O and thus, the length of the sides can be represented by the equations $L1_R=L2_F$ and $L1_F=L2_R$. Further, since the length between fasteners 42*a* and 47*a* of the first wiring 30 ($L1_F+L1_R$) and the length between fasteners 42*b* and 48*a* of the second wiring 31 ($L2_F+L2_R$) are equal, they can be obtained by the following equation according to Pythagorean theorem.

$$L1_F+L1_R=L2_F+L2_R=(A^2+B^2)^{1/2} \tag{2}$$

Figure 13B:
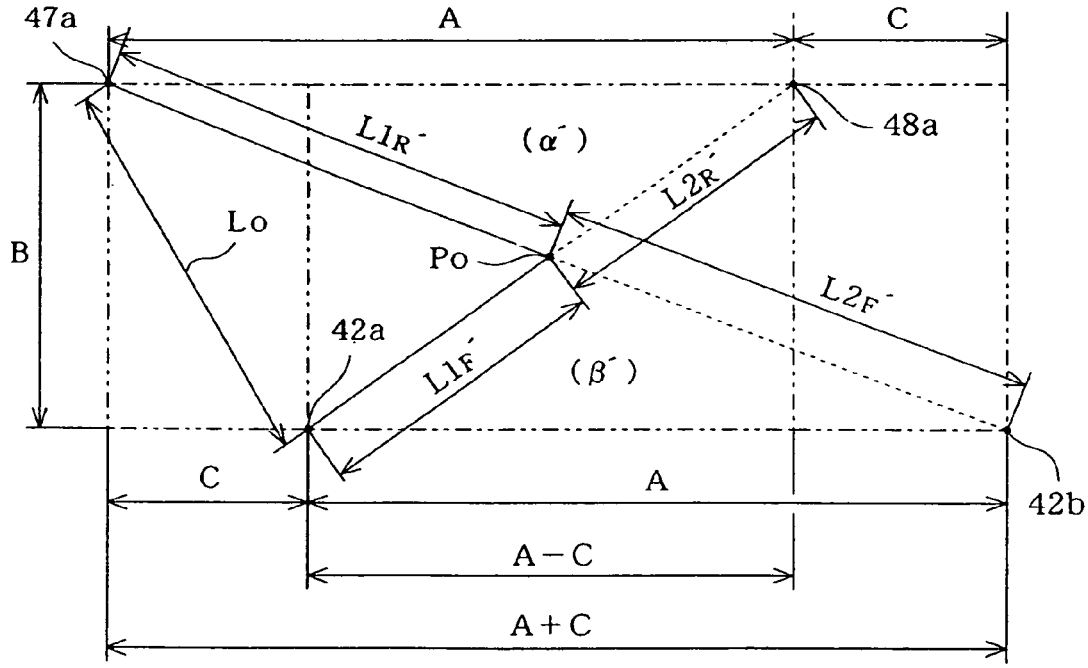
FIG. 13B corresponds to FIG. 13A showing the needle-bar case transferred to the rightmost position.

In contrast, as shown in FIG. 13B, in case the imaginary quadrilateral when needle-bar case 5 is at the rightmost position is a parallelogram, cross over $P_o$ of the first and second wirings 30 and 31 is located at the center of the parallelogram. This means that as needle-bar case 5 moves from the middle position toward the rightmost position, the first and second wirings 30 and 31 are displaced as if to draw the two diagonals of the parallelogram while cross over $P_o$ is also displaced to coincide with the center of the parallelogram. Thus, when needle-bar case 5 is at the rightmost position or the leftmost position, because imaginary triangle a' formed by side A, side $L1_R'$, and $L2_R'$ and triangle β' formed by side A, side $L1_F'$, and $L2_F'$ are point symmetric to symmetric point P0, the length of the sides can be represented by the equations $L1_R'=L2_F'$ and $L1_F'=L2_R'$. Thus, the lengths $L1_F'$, $L1_R'$, $L2_F'$, and $L2_R'$ of first and second wirings 30 and 31 can be obtained by the following equation according to Pythagorean theorem.

$$L1_R'=L2_F'=[\{(A+C)^2+B^2\}^{1/2}]½ \tag{3}$$

$$L1_F'=L2_R'=[\{(A-C)^2+B^2\}^{1/2}]½ \tag{4}$$

According to the present exemplary embodiment, the imaginary quadrilateral formed when needle-bar case 5 is in the middle position is a trapezoid to be specific, however, it can be generally described as being substantially rectangular, and hence, the above described equations (1) to (4) stand. Thus, as shown in FIGS. 13A and 13B, as needle-bar case 5 is transferred, the first and second wirings 30 and 31 vary their length from $L1_F$, $L1_R$, $L2_F$, and $L2_R$ to $L1_F'$, $L1_R'$, $L2_F'$, and $L2_R'$ on a given plane. However, the amount of variation is practically ignorable, and thus, slack is hardly observed in the first and second wirings 30 and 31 between the four fasteners 42*a* to 48*a* during the transfer of needle-bar case 5 to thereby maintain appropriate tension in the first and second wirings 30 and 31.

According to multi-needle sewing machine M of the present exemplary embodiment, the first and second wirings 30 and 31 are disposed so as to be separated from each other in the direction of transfer of needle-bar case 5, and the intermediate portions 30*a* and 31*a* of the first and second wirings 30 and 31 are crossed over in a curve. This allows appropriate play in the lengths of the first and second wirings 30 and 31 required for the transfer of needle-bar case 5 while allowing the first and second wirings 30 and 31 to crossover with appropriate tension operated on each other. Thus, even if needle-bar case 5 is transferred, variation in the tension of the first and second wirings 30 and 31 can be restrained as much as possible while preventing slack by establishing a hold at intermediate portions 30*a* and 31*a* to reliably prevent damages and disconnection of the wirings.

The first and second wirings 30 and 31 have been disposed to crossover at the substantial center of an imaginary quadrilateral formed by connecting the couple of fastening sections 47*a* and 48*a* of body side fastener 45 and the couple of fastening sections 42*a* and 42*b* of needle bar side fasteners 33*a* and 33*b*. Thus, by disposing the first and second wirings 30 and 31 so as to reside within a given plane with appropriate tension operated between them, they can be reliably prevented from entangling with components of multi-needle sewing machine M such as needle-bar case transfer mechanism 25 even if needle-bar case 5 is transferred, as well as allowing the organization of the wirings to be as compact as possible. Further, the above described configuration allows the play in the lengths of the first and second wirings 30 and 31 to be equal while optimizing the play in the lengths to prevent the wirings 30 and 31 from interfering with the transfer of needle-bar case 5. Yet, further, the length between fasteners 42*a* and 47*a* of the first wiring 30 ($L1_F+L1_R$) and the length between fasteners 42*b* and 48*a* of the second wiring 31 ($L2_F+L2_R$), and the length of $L1_F$ to $L2_R'$ of each segments of the first and the second wirings 30 and 31 can be obtained from equations (1) to (4). Still further, because the mutual distance of the four fasteners 42*a* to 48*a*, in other words, A and B, can be specified in anticipation of the minimum length L0 ($=(B^2+C^2)^{1/2}$) required in transferring needle-bar case 5 from the rightmost position to the left most position, the first and second wirings 30 and 31 can be organized without excessive play in their lengths.

Figure 14A:
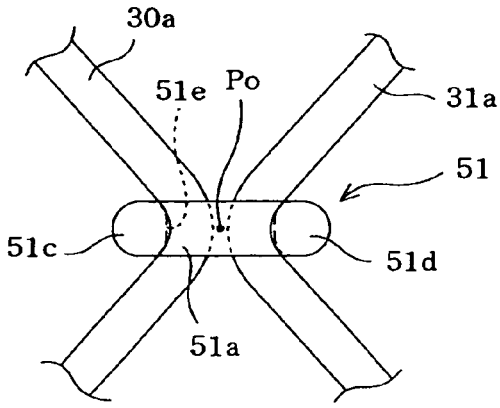
FIG. 14A is a plan view of a ring element according to a second exemplary embodiment of the present disclosure.
Figure 14B:
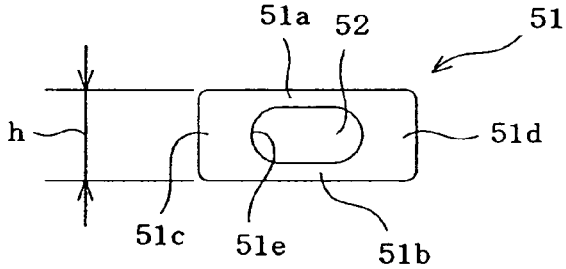
FIG. 14B is a front view of FIG. 14A.

FIGS. 14A and 14B indicate a second exemplary embodiment of the present disclosure and descriptions will be given hereinafter on only the portions that differ from the first exemplary embodiment. FIG. 14A is an enlarged plan view and FIG. 14B is an enlarged front view of curved portion $P_o$ and the elements that are identical to the first exemplary embodiment are identified with identical reference symbols.

The first and second wirings 30 and 31 of the second exemplary embodiment are gathered by ring element 51 at their intermediate portions 30*a* and 31*a*. Ring element 51 is made of a synthetic resin material, for example, and is configured as an annular holding element having insert hole 52 allowing insertion of the first and second wirings 30 and 31. As shown in FIG. 14B, upper surface 51*a* and lower surface 51*b* of ring element 51 is formed thinner than side surfaces 51*c* and 51*d* to reduce height h of ring element 1. Ring element 51 holds the first and second wirings 30 and 31 passed through insert hole 52 so as to be curved in close proximity of the other. Ring element 51 has inner periphery 51*e* that exhibits a gradual curve to allow smooth relational movement of the first and second wirings 30 and 31 relative to ring element 51. The first and second wirings 30 and 31 are held by ring element 51 at the substantial center of the imaginary quadrilateral. Thus, the first and second wirings 30 and 31 are held at their intermediate portions 30*a* and 31*a* by way of ring element 51 so as to allow relative movement between the first and second wirings 30 and 31.

According to the second exemplary embodiment, because the first and second wirings 30 and 31 are held at their intermediate portions 30*a* and 31*a* so as to be curved in close proximity to one another by ring element 51, they can be organized with appropriate tension operated on each other. Further, because the first and second wiring 30 and 31 are allowed to move relative to the other, they can be held by ring element 51 by preventing the variance in tension as much as possible without slacking even if needle-bar case 5 is transferred. Further, because the first and second wirings 30 and 31 are held in close proximity to one another without physical contact, no friction occurs between the wirings 30 and 31 to reliably prevent the wear of the wirings.

Further, the first and second wirings 30 and 31 are configured to reside within a given plane with appropriate tension operated between them. Thus, the play in the length of the first and second wirings 30 and 31 can be made equal etc., to provide the effects yielded by the first exemplary embodiment.

The holding element that holds the intermediate portions 30*a* and 31*a* of the first and second wirings 30 and 31 in a curved and proximate state is configured by ring element 51 that allows the first and second wiring 30 and 31 to be passed through it. This allows the holding element to be simplified as much as possible while establishing a reliable hold of intermediate portions 30*a* and 31*a* of the first and second wiring 30 and 31.

In the first exemplary embodiment, the first and second wirings 30 and 31 are placed on top of the other at cross over or curved section $P_o$. In contrast, the second exemplary embodiment employs ring element 51 designed to reduce its height h to hold the first and second wirings 30 and 31 without physical contact. Thus, the vertical thickness of curved section $P_o$ can be reduced as compared to when the first and second wirings are crossed over.

Figure 15A:
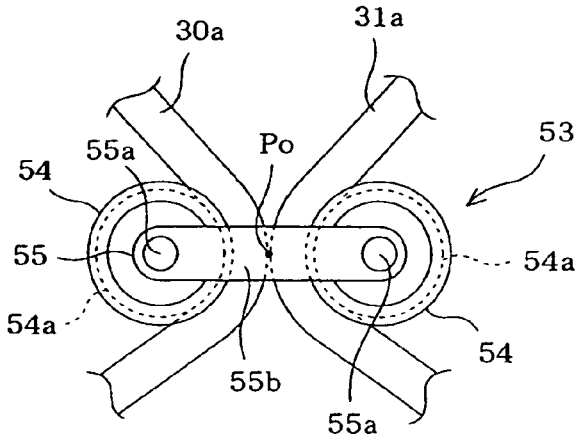
FIG. 15A is a plan view of a pulley and its support element according to a third exemplary embodiment.
Figure 15B:
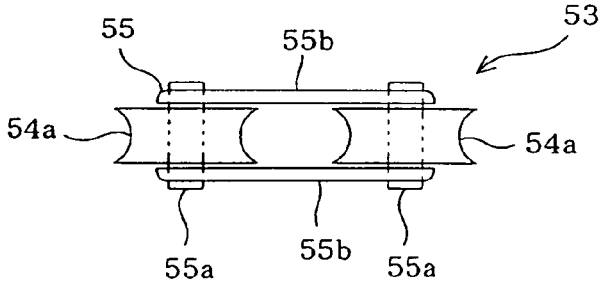
FIG. 15B is a front view of FIG. 15A.

FIGS. 15A and 15B illustrate a third exemplary embodiment of the present disclosure and a description will be given hereinafter on portions that differ from the first exemplary embodiment. FIGS. 15A and 15B correspond to FIGS. 14A and 14B and portions that are identical to the first exemplary embodiment are identified with identical reference symbols.

The first and second wirings 30 and 31 of the third exemplary embodiment are held at their intermediate portions by 30*a* and 31*a* by holding element 53. Holding element 53 is provided with a couple of pulleys 54 and support element that rotatably supports pulleys 54. Pulleys 54 are disc shaped and have guide grooves 54*a* on their edges that are recessed radially inward in arc shape in front view as viewed in FIG. 15B. Support element 55 comprises a couple of penetration shafts 55*a* that rotatably support pulleys 54 and a couple of support plates 55*b* that are provided at both upper and lower ends of penetration shafts 55*a* to support penetration shafts 55*a* at their left and right ends.

As shown in FIG. 15A, support element 55 holds the first and second wirings 30 and 31 at their intermediate portions 30*a* and 31 so as to be curved in close proximity to one another at guide recesses 54*a* of the couple of pulleys 54.

Thus, movement of the first and second wirings 30 and 31 relative to holding element 53 is permitted as well as allowing the wirings 30 and 31 to slide independently by each of pulleys 54. The first and second wirings 30 and 31 are held by holding element 53 at substantial center of the imaginary quadrilateral.

According to the third exemplary embodiment, when needle-bar case 5 is being moved, the sliding movement of the first and second wirings 30 and 31 relative to holding element 53 can be executed smoothly by pulleys 54. Further, because the first and second wirings are held at intermediate portions 30*a* and 31*a* that are gradually curved while reducing the friction between the first and second wirings 30 and 31, damaging and wear etc. of intermediate portions 30*a* and 31*a* of the first and second wirings 30 and 31 can be prevented. Further, because the first and second wirings 30 and 31 can be held by holding element 53 at the substantial center of the imaginary quadrilateral, the play in lengths of the first and second wirings 30 and 31 can be made equal etc., to obtain the effects provided in the second exemplary embodiment.

As described in the above first to third exemplary embodiments, the first and second wirings 30 and 31 are disposed so as to be separated from one another in the direction of transfer of needle-bar case 5, while crossing the intermediate portions 30*a* and 31*a* of the first and second wirings 30 and 31 over one another or placing them in close proximity to one another, to allow the first and second wiring 30 and 31 to be moved relative to the other at their intermediate portions 30*a* and 31*a*. Thus, each of the exemplary embodiments provide the common effects of securing optimal play in the length of the first and the second wirings 30 and 31 for transferring needle-bar case 5, while holding the wirings 30 and 31 with appropriate tension applied on one another. Hence, even if needle-bar case 5 is transferred, variance in the tension of the first and second wirings 30 and 31 can be restrained as much a possible while establishing a hold of their intermediate portions 30*a* and 31*a* without slack to reliably prevent damaging and disconnection etc., of the wirings.

In the above described exemplary embodiments, the first and second wirings 30 and 31 are not limited to lead wires but may employ other cords that are capable of transmitting signals. One or more than one wirings may be gathered for the first and second wirings 30 and 31 respectively.

The fasteners that fasten the first and second wirings 30 and 31 to sewing machine body 7 side or the needle-bar case 5 side are not limited to body side fastener 45 or needle-bar case side fasteners 33*a* and 33*b* but may employ a couple fasteners that fasten the first and second wirings 30 and 31 respectively at sewing machine body 7 side and a separate couple of fasteners that fasten the first and second wirings 30 and 31 at the needle-bar case 5 side, meaning that four fasteners constitute the fastening element.

The electrical components are not limited to lights 27*a* and 27*b* but may comprise any other electrical components.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A multi-needle sewing machine including a sewing machine body, comprising:

a plurality of needle bars that each allow attachment of a sewing needle at a lower end thereof;

a needle-bar case that supports the plurality of needle bars so as to be movable up and down;

a needle-bar case transfer mechanism that selectively switches one of the plurality of needle bars to a needle drop position by transferring the needle-bar case relative to the sewing machine body;

a first wiring and a second wiring that are each connected to an electrical component provided at the needle-bar case and that are each extended across the sewing machine body and the needle-bar case;

wherein the first and the second wiring are held such that the first wiring and the second wiring are separated in a direction of transfer of the needle-bar case and a first intermediate portion of the first wiring and a second intermediate portion of the second wiring are curved so as to either cross over or proximate one another to allow the first wiring and the second wiring to be moved relative to one another at the first intermediate portion and the second intermediate portion.

2. The multi-needle sewing machine according to claim 1, wherein the first wiring and the second wiring cross over so as to curve at the first intermediate portion and the second intermediate portion.

3. The multi-needle sewing machine according to claim 2, further comprising a body side fastener including a couple of fastening sections that fasten the first wiring and the second wiring respectively at the sewing machine side, and a couple of needle-bar case side fasteners including fasteners that fasten the first wiring and the second wiring at the needle-bar case side, wherein the first wiring and the second wiring are crossed over at a substantial center of an imaginary quadrilateral that is formed by connecting the couple of fastening elements of the body side fasteners and the fasteners of the couple of needle-bar case side fasteners respectively with imaginary lines.

4. The multi-needle sewing machine according to claim 1, further comprising a holding element that hold the first intermediate portion of the first wiring and the second intermediate portion of the second wiring so as to be curved in proximity to one another, wherein the holding element holds the first wiring and the second wiring to allow relative movement between the first wiring and the second wiring.

5. The multi-needle sewing machine according to claim 4, further comprising a body side fastener including a couple of fastening sections that fasten the first wiring and the second wiring respectively at the sewing machine side, and a couple of needle-bar case side fasteners including fasteners that fasten the first wiring and the second wiring at the needle-bar case side, wherein the first wiring and the second wiring are held by the holding element at a substantial center of an imaginary quadrilateral that is formed by connecting the couple of fastening elements of the body side fasteners and the fasteners of the couple of needle-bar case side fasteners respectively with imaginary lines.

6. The multi-needle sewing machine according to claim 4, wherein the holding element comprises a ring element that allows the first wiring and the second wiring to pass through.

7. The multi-needle sewing machine according to claim 5, wherein the holding element comprises a ring element that allows the first wiring and the second wiring to pass through.

8. The multi-needle sewing machine according to claim 4, wherein the holding element comprises a couple of pulleys and a support element that rotatably supports the pulleys, wherein the first wiring and the second wiring are slid independently by the couple of pulleys.

9. The multi-needle sewing machine according to claim 5, wherein the holding element comprises a couple of pulleys and a support element that rotatably supports the pulleys, wherein the first wiring and the second wiring are slid independently by the couple of pulleys.

* * * * *